US006863059B1

(12) United States Patent
Lee

(10) Patent No.: US 6,863,059 B1
(45) Date of Patent: Mar. 8, 2005

(54) THREE-AXIS ADJUSTMENT BALL PITCHING MACHINE

(76) Inventor: Wen-Hao Lee, No. 57-22, Chyan Liay Rd., Shen-Kang Hsiang, Taichung Hsien (TW)

( * ) Notice: Subject to any disclaimer, the term of this patent is extended or adjusted under 35 U.S.C. 154(b) by 0 days.

(21) Appl. No.: 10/885,685

(22) Filed: Jul. 8, 2004

(51) Int. Cl.[7] ..... F41B 4/00
(52) U.S. Cl. ..... 124/6
(58) Field of Search ..... 124/6, 78

(56) References Cited

U.S. PATENT DOCUMENTS

| | | | | | |
|---|---|---|---|---|---|
| 3,774,584 | A | * | 11/1973 | Paulson | 124/78 |
| 4,325,351 | A | * | 4/1982 | Yuasa | 124/78 |
| 4,583,514 | A | * | 4/1986 | Nozato | 124/78 |
| 5,437,261 | A | * | 8/1995 | Paulson et al. | 124/78 |
| 6,237,583 | B1 | * | 5/2001 | Ripley et al. | 124/78 |
| 6,732,724 | B1 | * | 5/2004 | Paulson et al. | 124/6 |

* cited by examiner

*Primary Examiner*—John A. Ricci
(74) *Attorney, Agent, or Firm*—Rosenberg, Klein & Lee

(57) ABSTRACT

A three-axis adjustment ball pitching machine includes an azimuth adjustment device, an elevation adjustment device, a strut, an angle adjustment device and a pitching assembly. The azimuth adjustment device includes a base on which the elevation adjustment device is rotatably mounted. The elevation adjustment device includes a body rotatably mounted on the base and an elevation adjustment assembly. The elevation adjustment assembly includes a pivot seat pivotally mounted in the body, a transitional cylinder movably mounted in the pivot seat to pivot the pivot seat, and a threaded leading rod rotatably mounted in the body and held in the transitional cylinder. The strut is attached to pivot seat. The angle adjustment device includes a mounting housing rotatably mounted on the strut. The pitching assembly is attached to the mounting housing of the angle adjustment device. Consequently, the pitching machine can throw balls in various desired trajectories.

7 Claims, 9 Drawing Sheets

THREE-AXIS ADJUSTMENT BALL PITCHING MACHINE

BACKGROUND OF THE INVENTION

1. Field of the Invention

The present invention relates to a ball pitching machine, and more particularly to a three-axis adjustment ball pitching machine for throwing balls, such as baseballs, softballs, or tennis balls in various desired directions or trajectories.

2. Description of Related Art

Practice is important and required for a player to become proficient at most sports. For baseball, softball or tennis, pitching machines are especially useful training aids for players to practice their skills of striking or catching balls. For baseball and softball practice, a player needs to practice both hitting and fielding. A pitching machine throws continuously balls toward a target area where a player hits the balls to practice hitting techniques. In addition, the pitching machines can also be used for fielders to practice catching fly balls or ground balls.

A conventional ball pitching machine comprises a pitching assembly and a supporting chassis. The pitching assembly is mounted on the supporting chassis and throws the balls. Positions of the pitching assembly are adjustable relative to the supporting chassis so that the balls can be accurately thrown toward the target area.

However, the conventional pitching machine only allows small elevation adjustments for the pitching assembly relative to the supporting chassis. Therefore, the target area for the balls is narrow because of the one-dimensional adjustment of the pitching assembly. The narrow target area cannot provide a great diversity of trajectories of the balls for the player to hit or catch the balls. The conventional pitching machine cannot simulate an actual pitcher throwing the balls for the batters to develop their techniques. Thus it is clear that the existing pitching machines do not provide adequate practice for players.

To overcome the shortcomings, the present invention provides a three-axis adjustment ball pitching machine to mitigate or obviate the aforementioned problems.

SUMMARY OF THE INVENTION

The main objective of the present invention is to provide a three-axis adjustment ball pitching machine for throwing balls, such as baseballs, softballs, and tennis balls in various desired directions and trajectories so that players can practice hitting and fielding.

A three-axis adjustment ball pitching machine in accordance with the present invention includes an azimuth adjustment device, an elevation adjustment device, a strut, an angle adjustment device and a pitching assembly. The azimuth adjustment device includes a base and an azimuth adjustment transmission assembly mounted in the base. The elevation adjustment device is rotatably mounted on the base and includes a body and an elevation adjustment assembly. The body is rotatably mounted on the base. The elevation adjustment assembly includes a pivot seat pivotally mounted in the body, a transitional cylinder movably mounted in the pivot seat to pivot the pivot seat and a threaded leading rod rotatably mounted in the body and rotatably held in the transitional cylinder. The strut is attached to pivot seat and has a horizontal segment so that pivoting the strut changes the elevations of the pitching assembly. The angle adjustment device is mounted on the horizontal segment of the strut and includes a mounting housing rotatably mounted on the horizontal segment. The pitching assembly is attached to the mounting housing of the angle adjustment device.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
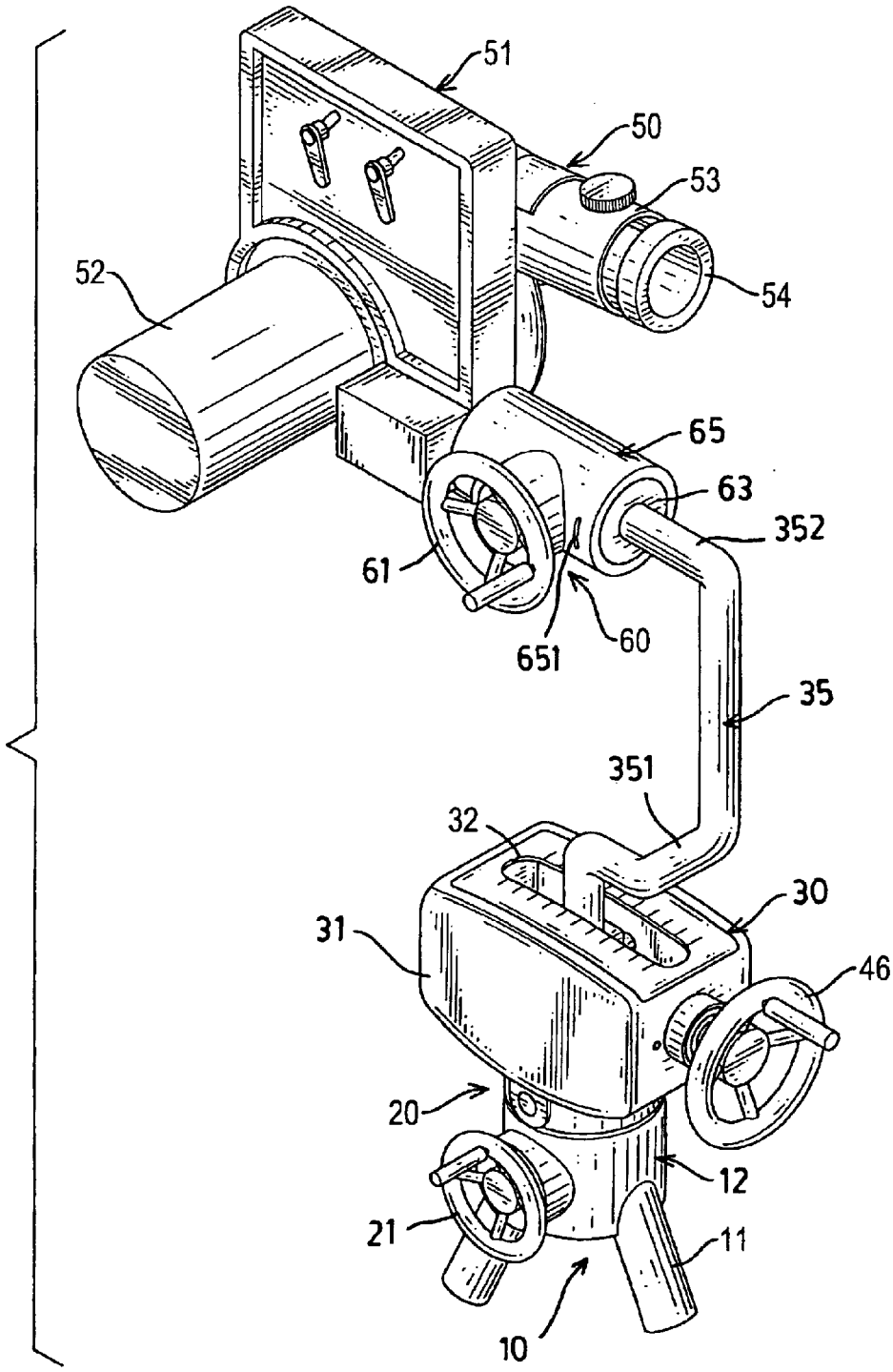
FIG. 1 is a perspective view of three-axis adjustment a ball pitching machine in accordance with the present invention.

With reference to FIG. 1, a three-axis adjustment ball pitching machine in accordance with the present invention comprises an azimuth adjustment device (20), an elevation adjustment device (30), a strut (35), a pitching assembly (50) and an angle adjustment device (60).

Figure 2:
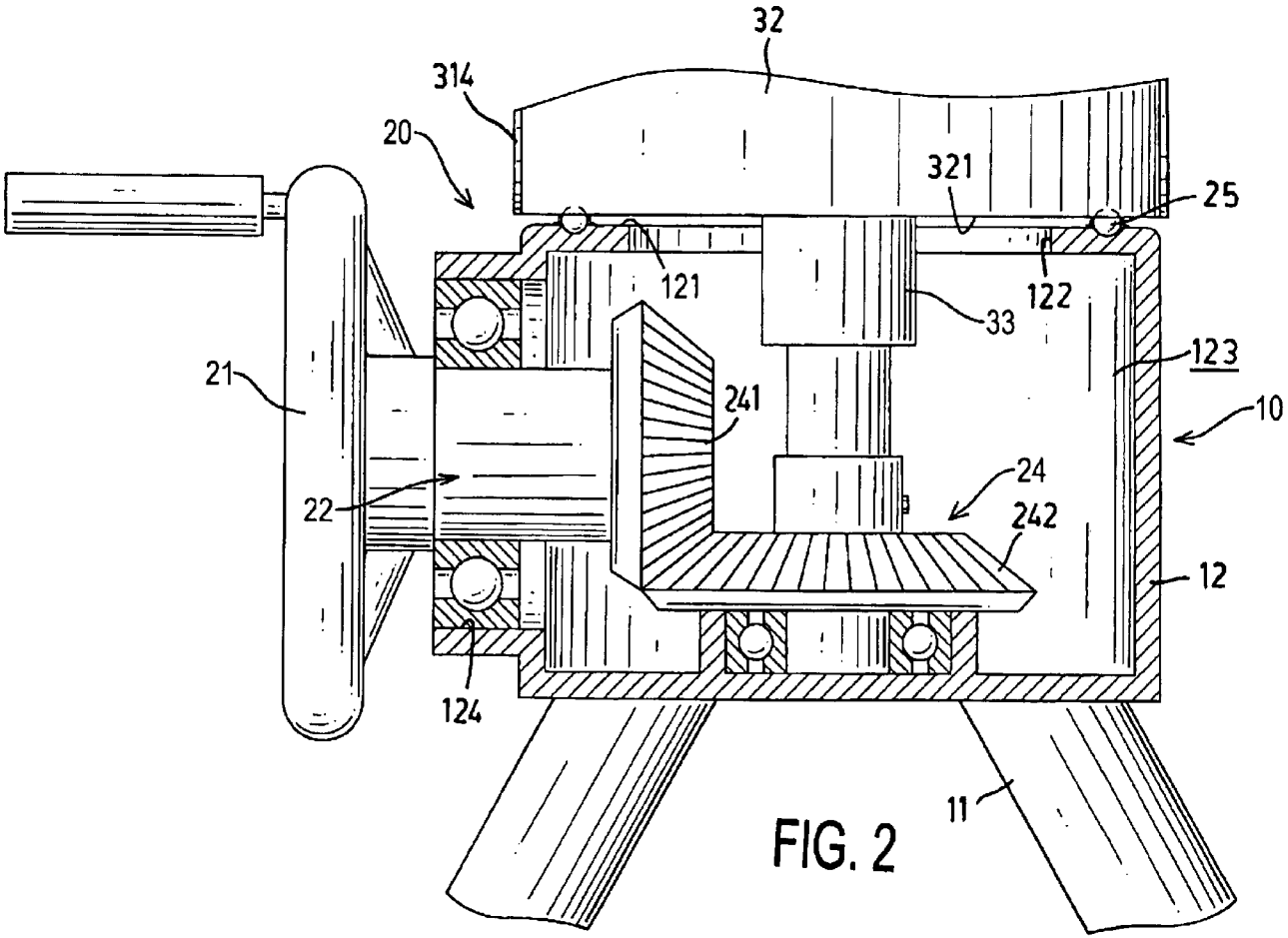
FIG. 2 is an enlarged elevational view in partial section of an azimuth adjustment device of the ball pitching machine in FIG. 1.
Figure 3:
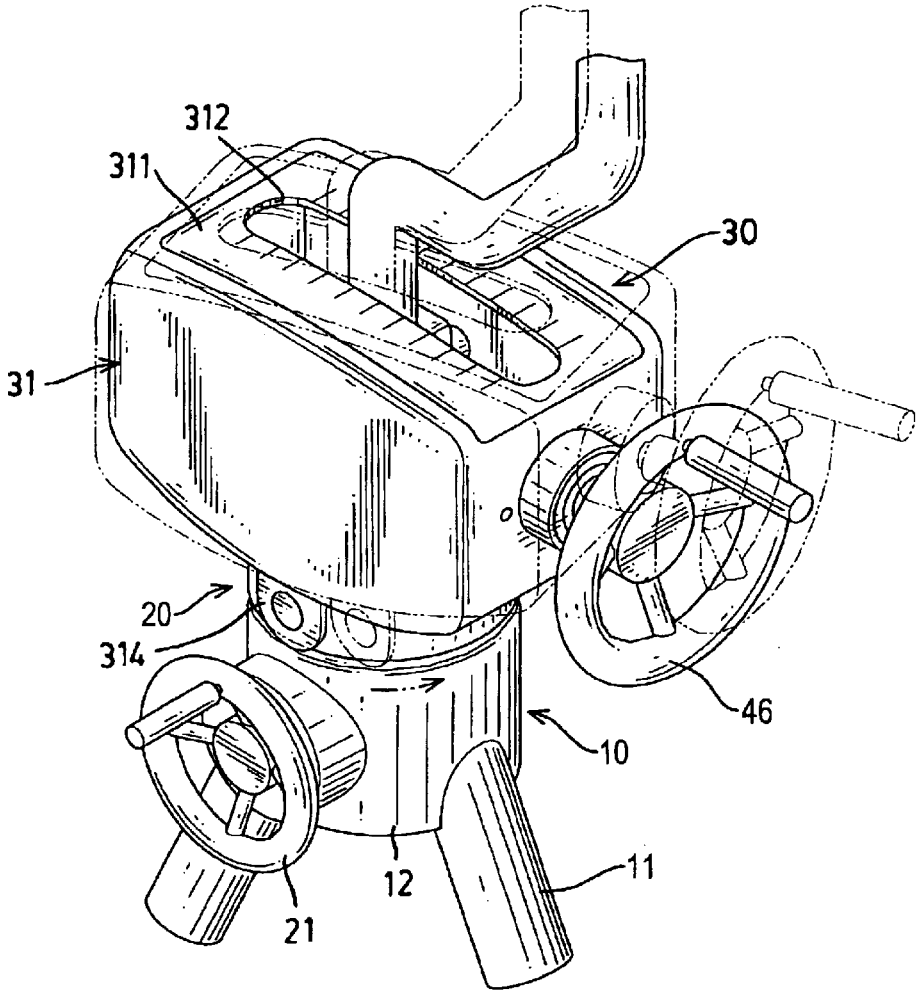
FIG. 3 is an operational perspective view of an elevation adjustment device of the ball pitching machine in FIG. 1.

With further reference to FIGS. 2 and 3, the azimuth adjustment device (20) comprises a base (10), an azimuth adjustment handwheel (21), a connecting shaft (22) and an azimuth adjustment transmission assembly (24).

The base (10) may be a tripod stand and comprises three legs (11) and a lower housing (12). The legs (11) are radially attached to the lower housing (12) and extend downwardly relative to the lower housing (12). The lower housing (12) is hollow and has a top (121), a top opening (122), an inner chamber (123) and a transverse hole (124). The top opening (122) is defined in the top (121) and communicates with the inner chamber (123). The transverse hole (124) communicates with the inner chamber (123).

The connecting shaft (22) is rotatably mounted and held in the transverse hole (124) by bearings. The azimuth adjustment handwheel (21) is attached to the connecting shaft (22) outside the lower housing (12) and rotates the connected connecting shaft (22) when the azimuth adjustment handwheel (21) is turned.

The azimuth adjustment transmission assembly (24) is mounted in the inner chamber (123) of the lower housing (12), is connected to the connecting shaft (22) and comprises a first bevel gear (241) and a second bevel gear (242). The first bevel gear (241) is attached to the connecting shaft (22), is rotated by the azimuth adjustment handwheel (21) through the connecting shaft (22) and meshes with the second bevel gear (242). The second bevel gear (242) is rotatably mounted and held in the inner chamber (123) and is rotated by the meshed first bevel gear (241) when the first bevel gear (241) is rotated.

Figure 4:
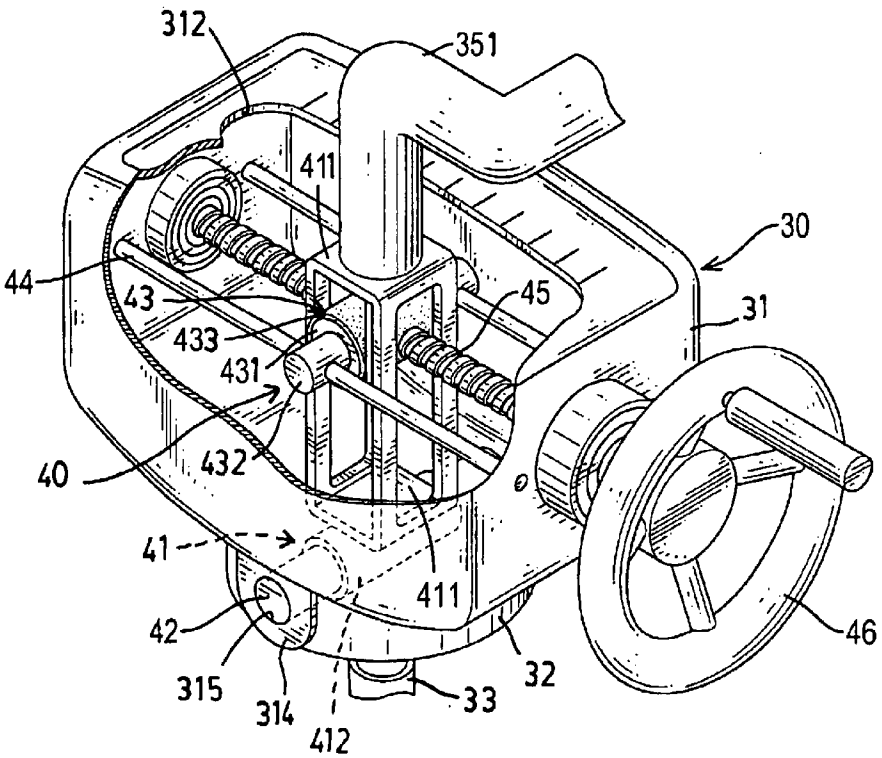
FIG. 4 is an enlarged perspective view in partial section of the elevation adjustment device in FIG. 3.

With reference to FIGS. 2, 3 and 4 the elevation adjustment device (30) is rotatably mounted on the top (121) of the lower housing (12) by multiple rollers (25) and comprises a body (31), an upper housing (32), a gear connecting rod (33) and an elevation adjustment assembly (40).

Figure 5:
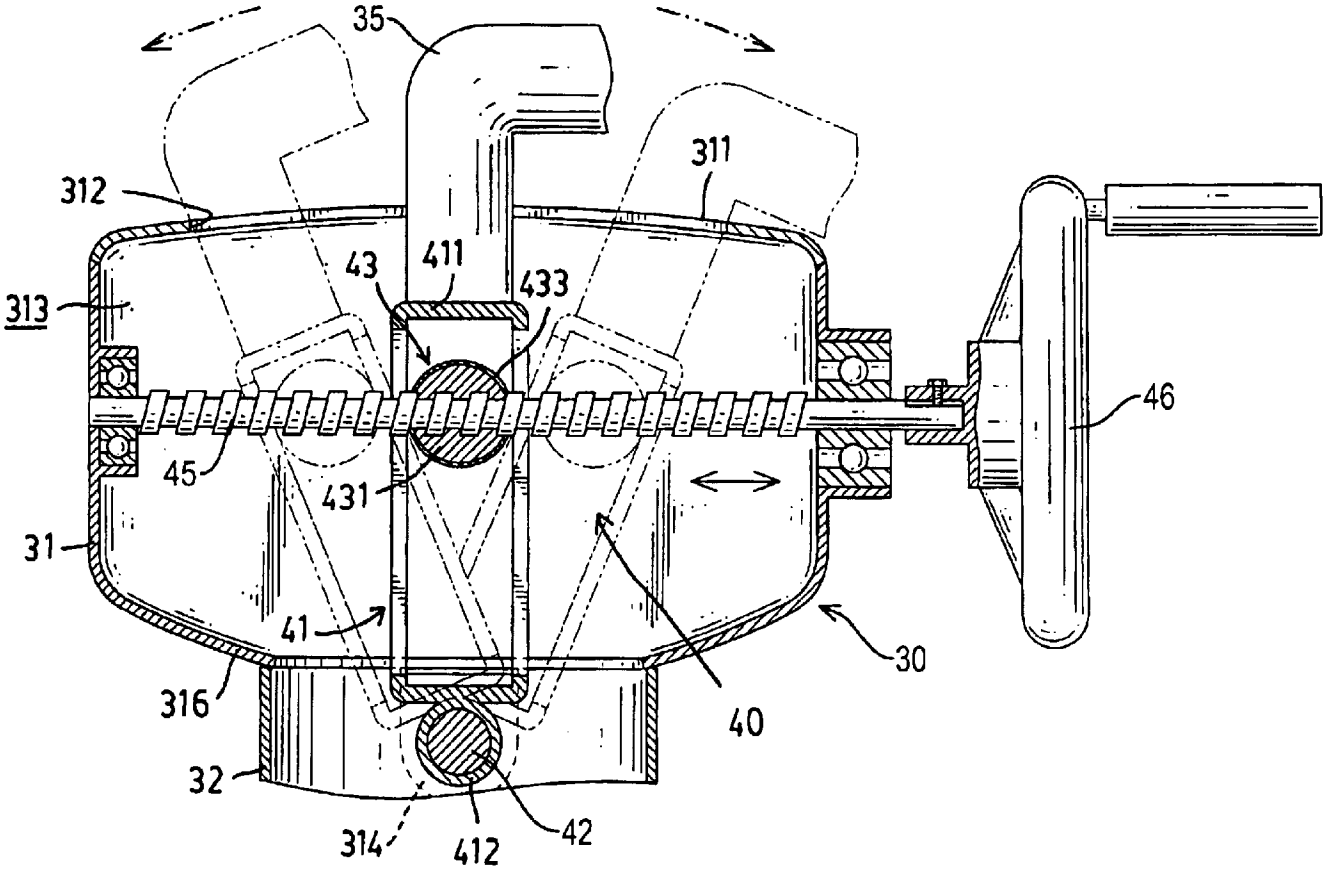
FIG. 5 is an operational elevational view in partial section of the elevation adjustment device in FIG. 3.

With further reference to FIG. 5, the body (31) is hollow and has a top (311), an elongated slot (312), an inner space (313), a bottom (316) and two mounting ears (314). The elongated slot (312) is defined in the top (311) of the body (31) and communicates with the inner space (313). The mounting ears (314) are attached to the bottom of the body (31) and are aligned with each other. Each of the mounting ears (314) has a through hole (315). The through holes (315) are aligned with each other.

The upper housing (32) is attached to the bottom (316) of the body (31) between the mounting ears (314) and has a bottom (321). The bottom (321) of the upper housing (32) is rotatably mounted on the top (121) of the lower housing (12) by the rollers (25). The rollers (25) are rolling balls and are mounted around the top opening (122) in the lower housing (12). The gear connecting rod (33) is attached to the bottom (312) of the upper housing (12), extends into the inner chamber (123) in the lower housing (12) through the top opening (122) and connects to the second bevel gear (242) of the azimuth adjustment transmission assembly (24). Therefore, the rotations of the second bevel gear (242) will rotate the upper housing (32) through the gear connecting rod (33) to adjust the azimuth of the elevation adjustment device (30).

With reference to FIGS. 4 and 5, the elevation adjustment assembly (40) comprises a pivot seat (41), a stationary pivot rod (42), a transitional cylinder (43), two guiding rods (44), a threaded leading rod (45) and an elevation adjustment handwheel (46).

The pivot seat (41) is pivotally mounted in the inner space (313) in the body (31), on which the strut (35) is attached to and comprises a hollow cage (411) and a pivot sleeve (412). The cage (411) has a top and a bottom. The strut (35) is attached to the top of the cage (411). The pivot sleeve (412) is attached to the bottom of the cage (411).

The stationary pivot rod (42) is mounted in the upper housing (32), is held in the pivot sleeve (412) and has two opposite ends. The ends of the stationary pivot rod (42) are attached to the upper housing (32), extend out of the upper housing (32) and are respectively held in the through holes (315) in the mounting ears (314) to unite the upper housing (32) with the body (31). Therefore, the rotations of the upper housing (32) will rotate simultaneously the body (31). The cage (411) can be pivoted about the stationary pivot rod (42) by the transitional cylinder (43).

The two guiding rods (44) are mounted in the inner space (313) in the body (31), are parallel with each other and are arranged alongside the elongated slot (312) in the body (31). The transitional cylinder (43) is movably mounted in the cage (411) to pivot the cage (411) about the stationary pivot rod (42) when the transitional cylinder (43) is moved by the threaded leading rod (45) and comprises a cylindrical body (431) and a damping coating (433). The cylindrical body (431) is movably mounted in the cage (411) and has two opposite end couplings (432). The end couplings (432) are slidably mounted on and held by the guiding rods (44). The damping coating (433) covers the cylindrical body (431) to absorb impacts or noises between the cage (411) and the cylindrical body (431) during adjusting operations. The threaded leading rod (45) is rotatably mounted in the inner space (313) in the body (31) between the guiding rods (44), is partially and rotatably held in the cylindrical body (431) and connects to the elevation adjustment handwheel (46).

Therefore, turning the elevation adjustment handwheel (46) rotates the threaded leading rod (45) to move the entire transitional cylinder (43) along the guiding rods (44). The movements of the transitional cylinder (43) pivot the cage (411) about the stationary pivot rod (42). The pivot movements of the cage (411) change angular positions of the strut (35) to adjust the elevations of the pitching assembly (50).

With reference to FIGS. 1 and 4, the strut (35) is attached to the top of the cage (411) and has a bent segment (351) and a horizontal segment (352). The bent segment (351) is formed outside the body (31). The horizontal segment (352) is integrally formed with the bent segment (352).

Figure 6:
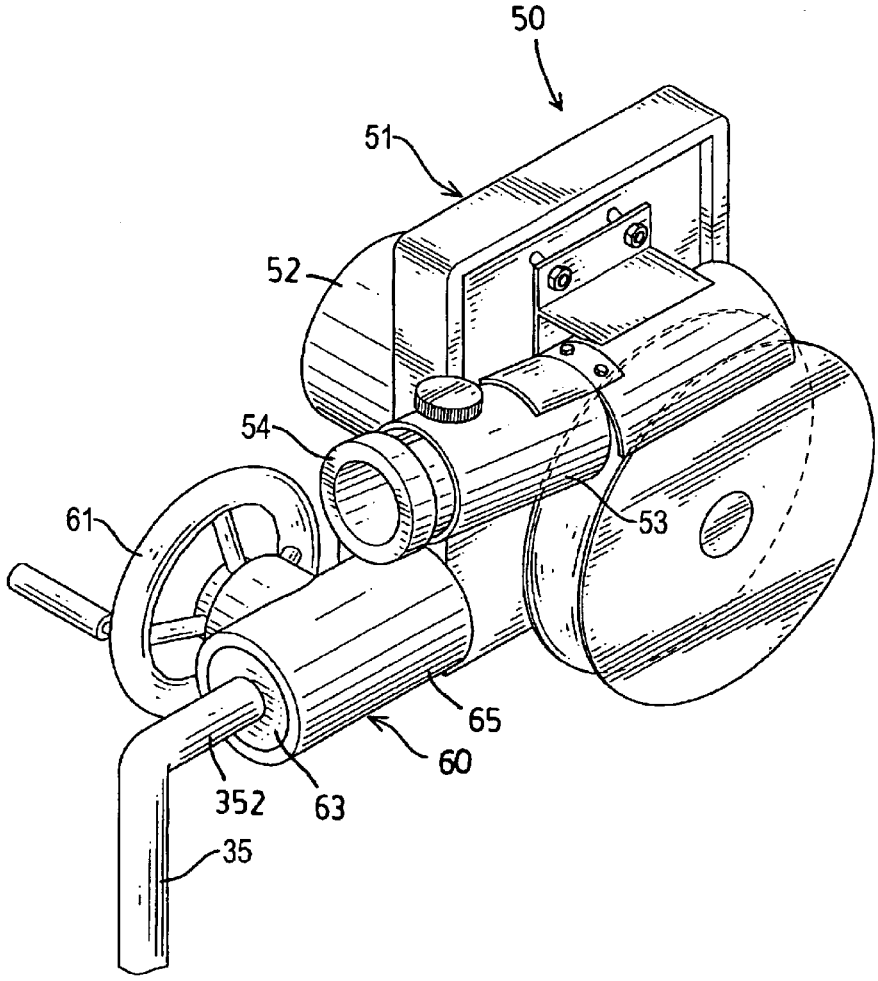
FIG. 6 is a perspective view of a pitching assembly and an angle adjustment device of the ball pitching machine in FIG. 1.
Figure 7:
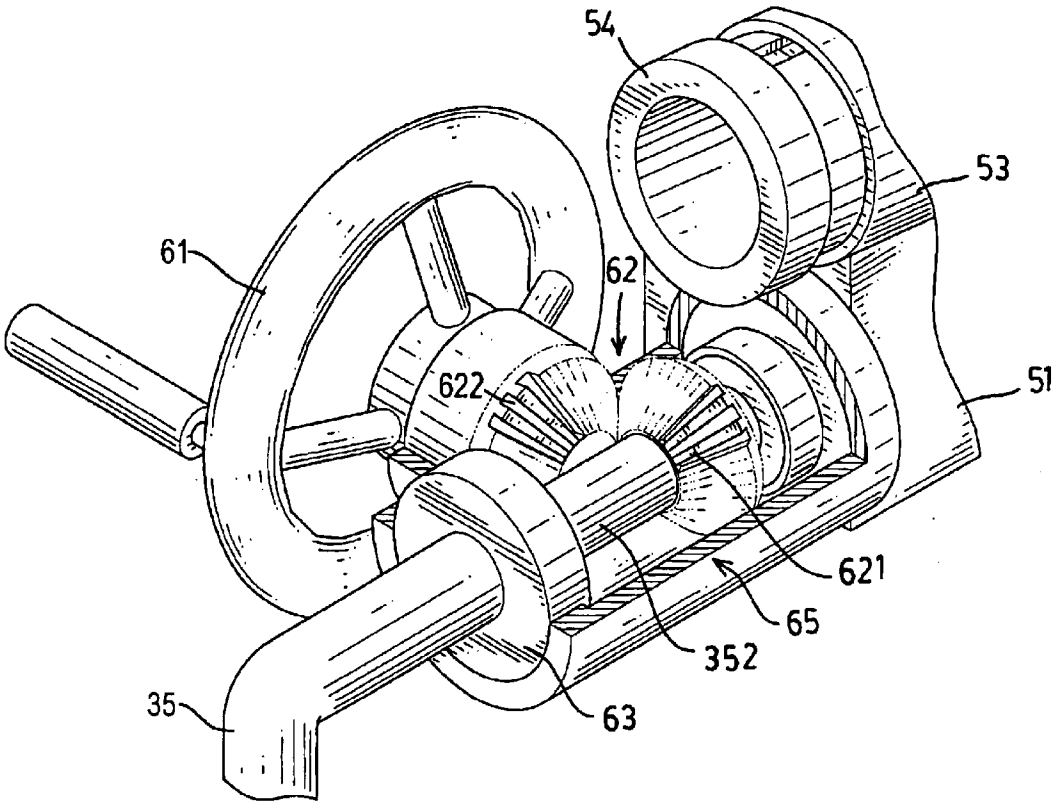
FIG. 7 is an enlarged perspective view in partial section of the angle adjustment device in FIG. 6.
Figure 8:
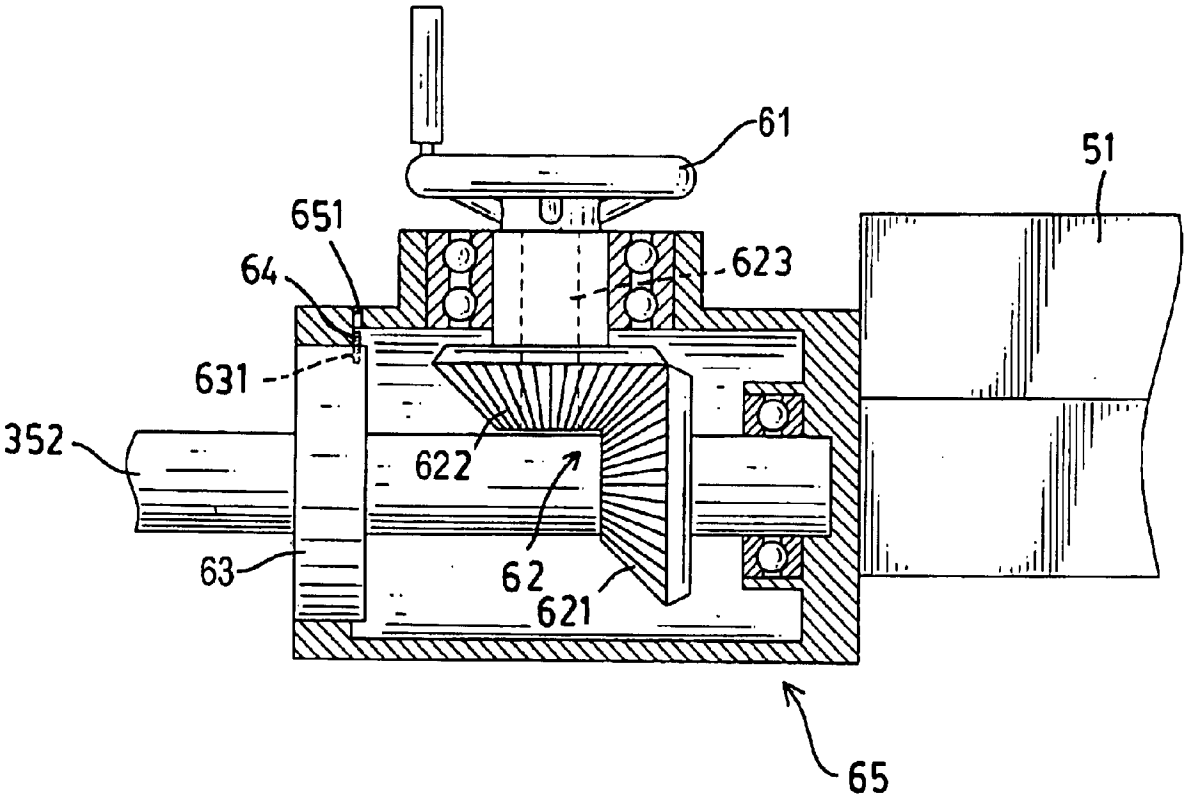
FIG. 8 is a top plan view in partial section of the angle adjustment device in FIG. 6.
Figure 9:
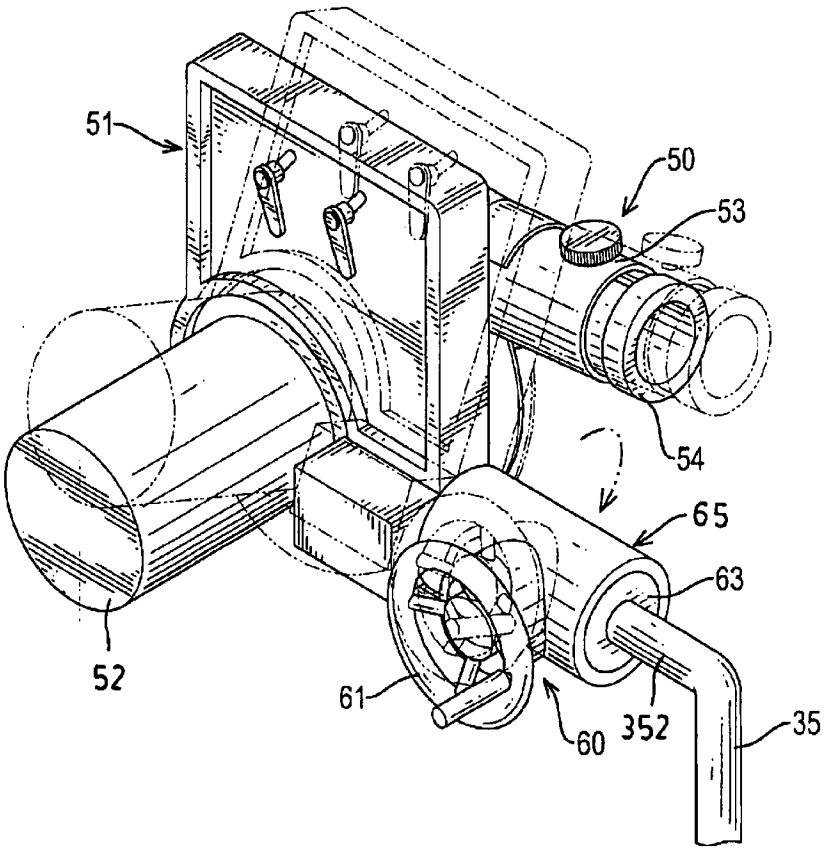
FIG. 9 is an operational perspective view of the pitching assembly and the angle adjustment device in FIG. 6.

With reference to FIGS. 6, 7 and 8, the angle adjustment device (60) is mounted on the horizontal segment (352) of the strut (35) and comprises an angle adjustment handwheel (61), an angle adjustment transmission device (62), a stationary disk (63), a positioning fastener (64) and a mounting housing (65).

The stationary disk (63) is attached to the horizontal segment (352) of the strut (35) and has a threaded hole (631). The mounting housing (65) is hollow and is rotatably mounted on the horizontal segment (352) of the strut (35) around the stationary disk (63) and has an elongated positioning hole (651) aligned with the threaded hole (631) of the stationary disk (63). The angle adjustment transmission device (62) is mounted in the mounting housing (65) and comprises a third bevel gear (621), a fourth bevel gear (622) and a connecting rod (623). The third bevel gear (621) is fixed on the horizontal segment (352) inside the mounting housing (65). The fourth bevel gear (622) meshes with the third bevel gear (621), connects to the connecting rod (623) and is rotated by the connecting rod (623). The angle adjustment handwheel (61) is attached to the connecting rod (623) to rotate the fourth bevel gear (622) through the connecting rod (623) when the connecting rod (623) is turned. The positioning fastener (64) may be a bolt or a screw, is mounted and held in the elongated positioning hole (651) and screws into the threaded hole (631) in the stationary disk (63) to position the mounting housing (65) on the horizontal segment (352). Therefore, turning the angle adjustment handwheel (61) allows adjustment of the angular positions of the entire angle adjustment device (60) about the horizontal segment (352).

The pitching assembly (50) is attached to the mounting housing (65) of the angle adjustment device (60) and comprises a mounting bracket (51), a driving motor (52), a throwing tube (53) and a ball fitting tube (54). The mounting bracket (51) is attached to the mounting housing (65) of the angle adjustment device (60). The throwing tube (53) is attached to the mounting bracket (51). The driving motor (52) is attached to the mounting bracket (51) and generates a variable speed controlled by varying frequency by a frequency converter to drive and urge a ball through the throwing tube (53). The ball fitting tube (54) is removably mounted in the throwing tube (53) and has a diameter accommodated for the ball size. For throwing a baseball, the ball fitting tube (54) is inserted and held in the throwing tube (53) so that the throwing tube (53) can be accommodated for the baseball size.

With reference to FIGS. 1, 3, 5 and 9, to achieve the objectives of three-axis adjustment of the pitching machine, a person can turn the handwheels (21, 46, 61) to adjust respectively the azimuths, elevations and angular positions for the pitching assembly (50). Turning the azimuth adjustment handwheel (21) to rotate the elevation adjustment device (30) through the azimuth adjustment transmission assembly (24) and the gear connection rod (33) allows adjusting the azimuths of the pitching assembly (50). Turning the elevation adjustment handwheel (46) to pivot the strut (35) through the threaded leading rod (45) and the pivot seat (41) allows adjustment of the elevations of the pitching assembly (50) with small increments. Turning the angle adjustment handwheel (61) to rotate the mounting housing (65) about the horizontal segment (352) through the angle adjustment transmission device (62) allows adjustment of the angular positions of the pitching assembly (50) about the horizontal segment (352) of the strut (35).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. A three-axis adjustment ball pitching machine comprising an azimuth adjustment device comprising a base having a lower housing and multiple legs radially attached to the lower housing, and the lower housing having a top, an inner chamber, a top opening defined in the top and communicating with the inner chamber and a transverse hole communicated with the inner chamber;

an azimuth adjustment transmission assembly mounted in the inner chamber of the lower housing;

a connecting shaft mounted and held rotatably in the transverse hole and connected to the azimuth adjustment transmission assembly; and an azimuth adjustment handwheel attached to the connecting shaft;

an elevation adjustment device rotatably mounted on the top of the lower housing and comprising a body having a top, a bottom, an elongated slot defined in the top and an inner space;

an upper housing attached to the bottom of the body and having a bottom rotatably mounted on the top of the lower housing;

a gear connecting rod attached to the bottom of the upper housing and connected to the azimuth adjustment transmission assembly through the connecting shaft; and an elevation adjustment assembly comprising a pivot seat pivotally mounted in the inner space in the body and comprising a hollow cage with a top and a bottom pivotally mounted in the inner space in the body and a pivot sleeve attached to the bottom of the cage;

a stationary pivot rod mounted in the upper housing, held in the pivot sleeve and having two opposite ends held in the upper housing;

two guiding rods mounted in the inner space in the body, being parallel with each other and arranged along the elongated slot in the body;

a transitional cylinder movably mounted in the cage to pivot the cage about the pivot rod and comprising a cylindrical body movably mounted in the cage and having two opposite end couplings respectively mounted on and slidably held by the guiding rods;

a threaded leading rod rotatably mounted in the inner space in the body between the guiding rods and rotatably held in the cylindrical body; and an elevation adjustment handwheel connected to the threaded leading rod to rotate the threaded leading rod to move the cylindrical body;

a strut attached to the top of the cage and having a bent segment formed outside the body and a horizontal segment integrally formed with the bent segment;

an angle adjustment device mounted on the horizontal segment and comprising a stationary disk attached to the horizontal segment of the strut;

a mounting housing rotatably mounted on the horizontal segment of the strut around the stationary disk;

an angle adjustment transmission device mounted in the mounting housing to rotate the mounting housing about the horizontal segment of the strut; and an angle adjustment handwheel connected to the angle adjustment transmission device; and a pitching assembly attached to the mounting housing of the angle adjustment device.

2. The three-axis adjustment ball pitching machine as claimed in claim 1, wherein the azimuth adjustment transmission assembly comprises a first bevel gear connected to the connecting shaft and rotated by the azimuth adjustment handwheel through the connecting shaft; and a second bevel gear rotatably mounted and held in the inner chamber, meshed with the first bevel gear and connected to the gear connecting rod of the elevation adjustment device.

3. The three-axis adjustment ball pitching machine as claimed in claim 1, wherein the transitional cylinder of the elevation adjustment assembly further comprises a damping coating covering the cylindrical body.

4. The three-axis adjustment ball pitching machine as claimed in claim 1, further comprises multiple rollers mounted around the top opening in the lower housing between the top of the lower housing and the bottom of the upper housing.

5. The three-axis adjustment ball pitching machine as claimed in claim 1, wherein the stationary disk has a threaded hole;

the mounting housing has an elongated positioning hole aligned with the threaded hole of the stationary disk; and the angle adjustment device further comprises a positioning fastener mounted and held in the elongated positioning hole and screwed into the threaded hole in the stationary disk.

6. The three-axis adjustment ball pitching machine as claimed in claim 1, wherein the pitching assembly comprises a mounting bracket attached to the mounting housing of the angle adjustment device;

a driving motor attached to the mounting bracket;

a throwing tube attached to the mounting bracket; and a ball fitting tube removably mounted in the throwing tube;

wherein the driving motor drives a ball to urge the ball through the throwing tube.

7. The three-axis adjustment ball pitching machine as claimed in claim 1, wherein the body of the elevation adjustment device further has two mounting ears, and each of the mounting ears is attached to the bottom of the body and has a through hole; and the ends of the stationary pivot rod in the upper housing extend out of the upper housing and are respectively held in the through holes in the mounting ears to unite the upper housing with the body.

* * * * *